US005698506A

United States Patent [19]

Angevaare et al.

[11] Patent Number: 5,698,506

[45] Date of Patent: Dec. 16, 1997

[54] AUTOMATIC DISHWASHING COMPOSITIONS CONTAINING ALUMINUM SALTS

[75] Inventors: Petrus Andrianus Angevaare, Ho-Ho-Kus; Richard Gerald Gary, West New York, both of N.J.

[73] Assignee: Lever Brothers Company, Division of Conopco, Inc., New York, N.Y.

[21] Appl. No.: 444,502

[22] Filed: May 19, 1995

[51] Int. Cl.[6] ..... C11D 1/94; C11D 3/08; C11D 3/395

[52] U.S. Cl. ..... 510/222; 510/223; 510/224; 510/226; 510/229; 510/372; 510/374; 510/375; 510/379; 510/380

[58] Field of Search ..... 252/95, 99, 102, 252/DIG. 11, 174.11, 174.12, 135, 174.19; 510/222, 223, 224, 226, 229, 372, 374, 375, 379, 380

[56] References Cited

U.S. PATENT DOCUMENTS

| | | | |
|---|---|---|---|
| 3,128,250 | 4/1964 | Lintner et al. | 252/99 |
| 3,255,117 | 6/1966 | Knapp et al. | 252/99 |
| 3,350,318 | 10/1967 | Green | 252/135 |
| 4,102,799 | 7/1978 | Finck | 252/99 |
| 4,199,468 | 4/1980 | Barford et al. | 252/103 |
| 4,226,736 | 10/1980 | Bush et al. | 252/136 |
| 4,306,987 | 12/1981 | Kaneko | 252/99 |
| 4,411,810 | 10/1983 | Dutton et al. | 252/99 |
| 4,933,101 | 6/1990 | Cilley et al. | 252/99 |
| 5,098,590 | 3/1992 | Dixit et al. | 252/99 |
| 5,200,236 | 4/1993 | Lang et al. | 427/213 |
| 5,624,892 | 4/1997 | Angevaare et al. | 510/223 |

FOREIGN PATENT DOCUMENTS 3023828 2/1982 Germany .

*Primary Examiner*—Paul Lieberman
*Assistant Examiner*—Gregory R. Delcotto
*Attorney, Agent, or Firm*—A. Kate Huffman

[57] ABSTRACT

A composition and method for inhibiting lead corrosion of fine tableware washed in automatic dishwashers is disclosed. The composition comprises an aluminum salt which dissolves at a rate to deliver less than 0.56 mM aluminum (III) per minute at 42° C. to a wash liquor, a bleaching agent, a builder and optionally a surfactant. The composition has a pH of less than about 10 and is substantially free of silicates.

17 Claims, No Drawings

AUTOMATIC DISHWASHING COMPOSITIONS CONTAINING ALUMINUM SALTS

FIELD OF THE INVENTION

This invention relates to automatic dishwashing detergent compositions containing an aluminum species which inhibits corrosion of fine tableware.

BACKGROUND OF THE INVENTION

It is well known in the art that automatic dishwashers corrode glassware particularly when cleaned with highly alkaline detergent compositions. See Newton, R. G., The Durability of Glass-A Review, Glass Technology Vol. 26 No. 1, Feb. 1985, pp. 21–38 and U.S. Pat. No. 4,933,101 (Cilley et al.). The visible forms of glassware corrosion are generally caused by hydrolysis and therefore dissolution of the glassware's silicate network. This dissolution is known to be very low at pH values below 9.5 and increases with increasing pH (see Kruger, A. A., The Role of the Surface on Bulk Physical Properties of Glasses, in Surface and Near-Surface Chemistry of Oxide Materials, eds. Nowotny, J., and Dufour, L. -C., pp. 413–448). Thus detergent compositions having an alkalinity of less than about pH 10 were conventionally believed to exert very low corrosivity towards glassware.

Cleaning restrictions forced prior art formulators to seek solutions to tableware corrosion while maintaining high alkalinity in detergent products. The art teaches that silicate in combination with fast dissolving aluminum salts avoids high alkalinity corrosion of glassware. See U.S. Pat. No. 3,350,318, issued on Oct. 31, 1967 to Green and U.S. Pat. No. 3,255,117 issued Jun. 7, 1966 to Knapp et al.

As detergent compositions have increasingly become based on enzymes allowing the products to be milder and more environmentally friendly, it was believed that glassware corrosion would not be a problem especially at pH values of less than about 10.

It has now been discovered that detergent formulations having neutral pH or low alkalinity significantly corrode fine tableware, particularly lead crystal glassware. It is believed that the lead and boron minerals of the tableware take part in the formation of the silicate network. When such minerals are extracted the silicate network falls apart readily. This corrosion is especially pronounced in the absence of silicate which is not always incorporated in low alkalinity or neutral pH products. It has further been observed that detergent compositions incorporating aluminum salts to inhibit corrosion compromise cleaning and leave significant stains on washed tableware.

It has been surprisingly discovered that by utilizing certain slow dissolving aluminum salts in automatic dishwashing compositions that tableware corrosion can be inhibited and that cleaning efficiency can be improved.

It has also been surprisingly discovered that by utilizing certain sequestrants in combination with any water soluble aluminum salt that both tableware corrosion and the negative impact on cleaning efficiency can be minimized.

It is thus an object of the present invention to provide improved pH-neutral to mildly alkaline automatic dishwashing detergent compositions which not only protect against tableware corrosion but also provide good cleaning performance in removing stains from tableware.

Another object of the invention is to provide a process for incorporating aluminum salts in automatic dishwashing detergent compositions to provide effective cleaning performance without tableware corrosion. Although the preparation of the compositions containing the slow dissolving aluminum salts may be by any conventional method, a premix of aluminum-sequestrant complexes must be prepared before the remaining components are added to form the aluminum-sequestrant compositions.

SUMMARY OF THE INVENTION

The compositions of the invention are automatic dishwashing detergent compositions comprising:

a) 1 to 20 wt. % of a bleaching agent selected from a peroxygen agent, hypohalite agent, corresponding salts and mixtures thereof;

b) 0.01 to about 25 wt. %, preferably 1 to 15, of an aluminum containing species characterized by a controlled transfer of aluminum(III) ions from the product to the surface of the tableware, either:

i) by being slow dissolving, the definition of slow dissolving aluminum salt being an aluminum salt dissolving at a rate to yield less than 0.56 mM aluminum(III) per minute at 42° C. to a wash liquor or;

ii) by being part of an aluminum-sequestrant complex in which the aluminum is bound by a sequestrant, said complex preventing for at least one hour, the precipitation of any aluminum compound from an aqueous solution of pH ranging from 7 to 10;

c) 1 to 75 wt. % of a builder, and d) 0 to 40 wt. % of a surfactant.

The automatic dishwashing composition has low levels or no added silicates and has a pH in the range of less than about 10.

The compositions containing the aluminum-sequestrant complexes are prepared by forming a premix of sequestrant and aluminum salt. It is essential that the premix be prepared in a specific order of steps, namely, forming a solution of sequestrant in water, where the solution has a pH not less than one pH unit greater than the pKa of at least one of the ionizable groups on the sequestrant; adding the aluminum salt to this solution; and adjusting the pH of the resulting solution to the same pH as during the initial dissolution of the sequestrant. Remaining components of the compositions are then added in a conventional manner.

The compositions of the invention may be in any variety of physical forms, namely, liquid, powder or gel.

DETAILED DESCRIPTION OF THE PREFERRED EMBODIMENTS

The compositions of the invention are effective cleaners which do not corrode tableware, particularly tableware for entertainment or decorative purposes. Such glassware generally has a high refractive index which gives the classic "sparkle" when cut into decorative shapes. For purposes of this invention, the lead content of such tableware is more than about 20% by weight.

Slow Dissolving Aluminum Salts

The term "slow dissolving aluminum salt" refers to an aluminum salt that dissolves at a rate to yield less than 0.56 mM aluminum(III) per minute at 42° C.

Slow dissolving aluminum salts within the scope of the invention include: aluminum stearate, aluminum tartrate, aluminum acetate, aluminum acetotartrate, aluminum salicylate, aluminum bis(acetylsalicylate), aluminum formate, aluminum octoate, aluminum borate, aluminum oleate, aluminum palmitate, aluminum acetylacetonate, aluminum phosphate and mixtures thereof. Preferred aluminum salts include aluminum acetate, aluminum acetylacetonate, aluminum octoate and aluminum phosphate. Most preferred aluminum salts include aluminum acetate, aluminum acetylacetonate and aluminum octoate.

The aluminum salt should be incorporated in the detergent composition in an amount to deliver about 0.1 mM to about 10 mM, preferably 0.5 mM to about 5 mM, most preferably about 1 mM to 2 mM Al(III) in the wash.

Aluminum-Sequestrant Complexes

The term "aluminum-sequestrant complex" refers to a system containing an aluminum salt and a sequestrant which, when prepared properly, results in a reduced release rate of Al(III) ions.

Aluminum salts useful to form the aluminum-sequestrant complexes within the scope of the invention include: aluminum sulfate, sodium aluminate, aluminum acetate, aluminum acetylacetonate, aluminum formate, aluminum borate, aluminum octoate, aluminum oleate, aluminum palmitate, aluminum tartrate, aluminum acetotartrate, and mixtures thereof. Preferred aluminum salts include: aluminum sulfate, sodium aluminate, aluminum acetate, aluminum acetylacetonate, and aluminum borate. Most preferred aluminum salts include: aluminum sulfate, sodium aluminate, and aluminum acetylacetonate.

Sequestrants within the scope of the invention include the following acids and their alkali metal salts: EDTA, oxalic acid, citric acid, cyanuric acid, NTA, sodium orthophosphoric acid, malonic acid, succinic acid, tartaric acid, aspartic acid, glutamic acid, phosphonic acid, and polyphosphoric acid. Preferred sequestrants include: EDTA, oxalic acid, sodium citrate, and cyanuric acid. Most preferred sequestrants include: sodium citrate, oxalic acid, and cyanuric acid.

The aluminum-sequestrant complex is prepared as follows: with stirring, the desired amount of the selected sequestrant is added to water. During dissolution of the sequestrant, the pH of the solution is adjusted with an inorganic acid, or an inorganic base, preferably NaOH or $H_2SO_4$ to a pH of not less than one pH unit above the pKa of at least one of the ionizable groups on the sequestrant. This mixture is allowed to stir until the sequestrant is completely dissolved. The aluminum salt is dosed into the solution of the sequestrant and allowed to dissolve. During the dissolution of the aluminum salt, the pH of the system is adjusted to the same pH as during the initial dissolution of the sequestrant with NaOH or $H_2SO_4$, as necessary. After the aluminum salt is completely dissolved, the complex is ready for use.

Alkalinity

The alkalinity of an aqueous solution of the compositions should be neutral to low alkalinity, preferably less than a pH of 10, most preferably 7 to 9. Maintenance of the composition's pH within the desired range provides stain removal while inhibiting corrosion of fine tableware.

The aluminum salts can interact with tea stains so that the incorporation of slow dissolving aluminum salts in the compositions allows effective bleaching before substantial levels of Al(III) are released into the wash water.

In the aluminum-sequestrant complexes, on the other hand, the aluminum is bound to the sequestrant strongly enough to delay interaction of Al(III) with tea stains.

Any number of conventional buffer agents may be used to maintain the desired pH range. Such materials can include, for example, various water soluble inorganic salts such as the carbonates, bicarbonates, sesquicarbonates, silicates, pyrophosphates, phosphates, tetraborates and mixtures thereof.

The buffering agents should be present in the compositions in a amount of from about 2 to about 30 wt. %, preferably from 5 to about 25% by wt. of the total composition.

Detergent Builder Materials

The compositions of this invention can further contain all manner of detergent builders commonly taught for use in automatic dishwashing of compositions to increase the effectiveness of the detergent by in part, binding calcium salts to act as a softener. The builders can include any of the conventional inorganic and organic water-soluble builder salts, or mixtures thereof and may comprise 1 to 75%, and preferably, from about 5 to about 70% by weight of the cleaning composition.

Typical examples of phosphorus-containing inorganic builders, when present, include the water-soluble salts, especially alkali metal pyrophosphates, orthophosphates and polyphosphates. Specific examples of inorganic phosphate builders include sodium and potassium tripolyphosphates, phosphates, pyrophosphates and hexametaphosphates.

Suitable examples of non-phosphorus-containing inorganic builders, when present, include water-soluble alkali metal carbonates, bicarbonates, sesquicarbonates, borates, silicates, metasilicates, and crystalline and amorphous aluminosilicates. Specific examples include sodium carbonate (with or without calcite seeds), potassium carbonate, sodium and potassium bicarbonates, silicates and zeolites.

Particularly preferred inorganic builders can be selected from the group consisting of sodium tripolyphosphate, potassium pyrophosphate, sodium carbonate, potassium carbonate, sodium bicarbonate, sodium silicate and mixtures thereof. When present in these compositions, sodium tripolyphosphate concentrations will range from about 2% to about 40%; preferably from about 5% to about 30%. Sodium carbonate and bicarbonate when present can range from about 5% to about 50%; preferably from about 10% to about 30% by weight of the cleaning compositions. Sodium tripolyphosphate and potassium pyrophosphate are preferred builders in gel formulations, where they may be used at from about 3 to about 30%, preferably from about 10 to about 20%.

Organic detergent builders can also be used in the present invention. Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/ polymethacrylate copolymers, aminopolycarboxylates and polyacetal carboxylates such as those described in U.S. Pat. Nos. 4,144,226 and 4,146,495.

Alkali metal citrates, oxydisuccinates, polyphosphates and acrylate/maleate copolymers are especially preferred organic builders. When present they are preferably available from about 1% to about 35% of the total weight of the detergent compositions.

The foregoing detergent builders are meant to illustrate but not limit the types of builders that can be employed in the present invention.

Surfactants

Useful surfactants include anionic, nonionic, cationic, amphoteric, zwitteronic types and mixtures of these surface active agents. Such surfactants are well known in the detergent art and are described at length in "Surface Active Agents and Detergents", Vol. II, by Schwartz, Perry & Birch, Interscience Publishers, Inc. 1959, herein incorporated by reference.

Anionic synthetic detergents can be broadly described as surface active compounds with one or more negatively charged functional groups. Soaps are included within this category. A soap is a $C_8$–$C_{22}$ alkyl fatty acid salt of an alkali metal, alkaline earth metal, ammonium, alkyl substituted ammonium or alkanolammonium salt. Sodium salts of tallow and coconut fatty acids and mixtures thereof are most common. Another important class of anionic compounds are the water-soluble salts, particularly the alkali metal salts, of organic sulfur reaction products having in their molecular structure an alkyl radical containing from about 8 to 22 carbon atoms and a radical selected from the group consisting of sulfonic and sulfuric acid ester radicals. Organic sulfur based anionic surfactants include the salts of $C_{10}$–$C_{16}$ alkylbenzene sulfonates, $C_{10}$–$C_{22}$ alkane sulfonates, $C_{10}$–$C_{22}$ alkyl ether sulfates, $C_{10}$–$C_{22}$ alkyl sulfates, $C_4$–$C_{10}$ dialkylsulfosuccinates, $C_{10}$–$C_2$ acyl isothionates, alkyl diphenyloxide sulfonates, alkyl napthalene sulfonates, and 2-acetamido hexadecane sulfonates. Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Nonionic surfactants can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are:

(a) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid, (b) polyoxyethylene or polyoxypropylene condensates of aliphatic alcohols, whether linear- or branched-chain and unsaturated or saturated, containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol. Particularly preferred nonionic surfactant compounds in this category are the "Neodol" type products, a registered trademark of the Shell Chemical Company.

Also included within this category are nonionic surfactants having a formula:

$$R-(CH_2\underset{\underset{R^1}{|}}{C}HO)_x(CH_2CH_2O)_y(CH_2\underset{\underset{R^2}{|}}{C}HO)_zH \quad (I)$$

wherein R is a linear alkyl hydrocarbon radical having an average of 6 to 18 carbon atoms, $R^1$ and $R^2$ are each linear alkyl hydrocarbons of about 1 to about 4 carbon atoms, x is an integer of from 1 to 6, y is an integer of from 4 to 20 and z is an integer from 4 to 25.

One preferred nonionic surfactant of formula I is Poly-Tergent SLF-18® a registered trademark of the Olin Corporation, New Haven, Conn, having a composition of the above formula where R is a $C_6$–$C_{10}$ linear alkyl mixture, $R^1$ and $R^2$ are methyl, x averages 3, y averages 12 and z averages 16. Also suitable are alkylated nonionics as are described in U.S. Pat. No. 4,877,544 (Gabriel et al.), incorporated herein by reference.

Another nonionic surfactant included within this category are compounds of formula:

$$R^3-(CH_2CH_2O)aH \quad (II)$$

wherein $R^3$ is $a_6$–$C_{24}$ linear or branched alkyl hydrocarbon radical and q is a number from 2 to 50; more preferably $R^3$ is a $C_8$–$C_{18}$ linear alkyl mixture and q is a number from 2 to 15.

(c) polyoxyethylene or polyoxypropylene condensates of alkyl phenols, whether linear- or branched-chain and unsaturated or saturated,containing from about 6 to 12 carbon atoms and incorporating from about 2 to about 25 moles of ethylene oxide and/or propylene oxide.

(d) polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbitan monostearate, sorbitan monoisostearate, sorbital tristearate, sorbitan monooleate, and sorbitan trioleate. The polyoxyethylene chains may contain between about 4 and 30 ethylene oxide units, preferably about 20. The sorbitan ester derivatives contain 1, 2 or 3 polyoxyethylene chains dependent upon whether they are mono-, di- or tri-acid esters.

(e) polyoxyethylene-polyoxypropylene block copolymers having formula:

$$HO(CH_2CH_2O)_a(CH(CH_3)CH_2O)_b(CH_2CH_2O)_cH \quad (III)$$

or $$HO(CH(CH_3)CH_2O)_d(CH_2CH_2O)_e(CHCH_3CH_2O)_fH \quad (IV)$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art.

They are available under the trademark "Pluronic" and "Pluronic R", a product of BASF Corporation.

(f) Alkyl glycosides having formula:

$$R^4O(R^5O)_n(Z^1)_p \quad (V)$$

wherein $R^4$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^5$ is a divalent hydrocarbon radical containing from 2 to about 4 carbon atoms such as ethylene, propylene or butylene (most preferably the unit $(R^5O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Within the compositions of the present claim, alkyl polyglycosides will be present in amounts ranging from about 0.01 to about 20% by weight, preferably from about 0.5 to about 10%, optimally between about 1 and 5%.

Examples of commercially available materials from Henkel Kommanditgesellschaft Aktien of Dusseldorf, Germany include APG® 300, 325 and 350 with $R^4$ being $C_9$–$C_{11}$, n is 0 and p is 1.3, 1.6 and 1.8–2.2 respectively; APG® 500 and 550 with $R^4$ is $C_{12}$–$C_{13}$, n is 0 and p is 1.3 and 1.8–2.2, respectively; and APG® 600 with $R^4$ being $C_{12}$–$C_{14}$, n is 0 and p is 1.3. Particularly preferred is APG® 600.

(g) Amine oxides having formula:

$$R^5R^6R^7N{=}O \qquad \text{(VI)}$$

wherein $R^5$, $R^6$ and $R^7$ are saturated aliphatic radicals or substituted saturated aliphatic radicals. Preferable amine oxides are those wherein $R^5$ is an alkyl chain of about 10 to about 20 carbon atoms and $R^6$ and $R^7$ are methyl or ethyl groups or both $R^5$ and $R^6$ are alkyl chains of about 6 to about 14 carbon atoms and $R^7$ is a methyl or ethyl group.

Amphoteric synthetic detergents can be broadly described as derivatives of aliphatic and tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines. Besides alkyl betaines, alkyl amino and alkyl amido betaines are encompassed within this invention.

Silicates

If silicates are present in the compositions of the invention, they should be in an amount to provide neutral or low alkalinity (less than pH 10) of the composition. Preferred amounts of silicates present should be from about 1 to about 5%. Especially preferred is sodium silicate in a ratio of $SiO_2$:$Na_2O$ up from about 1.0 to about 3.3, preferably from about 2 to about 3.2.

Filler

An inert particulate filler material which is water-soluble may also be present in cleaning compositions in powder form. This material should not precipitate calcium or magnesium ions at the filler use level. Suitable for this purpose are organic or inorganic compounds. Organic fillers include sucrose esters and urea. Representative inorganic fillers include sodium sulfate, sodium chloride and potassium chloride. A preferred filler is sodium sulfate. Its concentration may range from 0% to 60%, preferably from about 10% to about 30% by weight of the cleaning composition.

Thickeners and Stabilizers

Thickeners are often desirable for liquid cleaning compositions. Thixotropic thickeners such as smectite clays including montmorillonite (bentonite), hectorite, saponite, and the like may be used to impart viscosity to liquid cleaning compositions. Silica, silica gel, and aluminosilicate may also be used as thickeners. Salts of polyacrylic acid (of molecular weight of from about 300,000 up to 6 million and higher), including polymers which are cross-linked may also be used alone or in combination with other thickeners. Use of clay thickeners for automatic dishwashing compositions is disclosed for example in U.S. Pat. Nos. 4,431,559; 4,511,487; 4,740,327; 4,752,409. Commercially available synthetic smectite clays include Laponite supplied by Laporte Industries. Commercially available bentonite clays include Korthix H and VWH ex Combustion Engineering, Inc.; Polargel T ex American Colloid Co.; and Gelwhite clays (particularly Gelwhite GP and H) ex English China Clay Co. Polargel T is preferred as imparting a more intense white appearance to the composition than other clays. The amount of clay thickener employed in the compositions is from 0.1 to about 10%, preferably 0.5 to 5%. Use of salts of polymeric carboxylic acids is disclosed for example in UK Patent Application GB 2,164,350A, U.S. Pat. No. 4,859,358 and U.S. Pat. No. 4,836,948.

For liquid formulations with a "gel" appearance and rheology, particularly if a clear gel is desired, a chlorine stable polymeric thickener is particularly useful. U.S. Pat. No. 4,260,528 discloses natural gums and resins for use in clear autodish detergents, which are not chlorine stable. Acrylic acid polymers that are cross-linked manufactured by, for example, B.F. Goodrich and sold under the trade name "Carbopol" have been found to be effective for production of clear gels, and Carbopol 940 and 617, having a molecular weight of about 4,000,000 is particularly preferred for maintaining high viscosity with excellent chlorine stability over extended periods. Further suitable chlorine-stable polymeric thickeners are described in U.S. Pat. No. 4,867,896 incorporated by reference herein.

The amount of thickener employed in the compositions is from 0 to 5%, preferably 0.5–3%.

Stabilizers and/or co-structurants such as long chain calcium and sodium soaps and $C_{12}$ to $C_{18}$ sulfates are detailed in U.S. Pat. Nos. 3,956,158 and 4,271,030 and the use of other metal salts of long chain soaps is detailed in U.S. Pat. No. 4,752,409. Other co-structurants include Laponite and metal oxides and their salts as described in U.S. 4,933,101, herein incorporated by reference. The amount of stabilizer which may be used in the liquid cleaning compositions is from about 0.01 to about 5% by weight of the composition, preferably 0.01–2%. Such stabilizers are optional in gel formulations. Co-structurants which are found especially suitable for gels include trivalent metal ions at 0.01–4% of the compositions, Laponite and/or water-soluble structuring chelants at 1–60%. These co-structurants are more fully described in the co-pending U.S. Pat. No. 5,141,664 by Corring et al., filed Dec. 30, 1987, which application is hereby incorporated by reference.

Defoamer

The formulations of the cleaning composition comprising surfactant may further include a defoamer. Suitable defoamers include mono- and distearyl acid phosphate, silicone oil and mineral oil. Even if the cleaning composition has only defoaming surfactant, the defoamer assists to minimize foam which food soils can generate. The compositions may include 0.02 to 2% by weight of defoamer, or preferably 0.05–1.0%.

Minor amounts of various other components may be present in the cleaning composition. These include bleach scavengers including but not limited to sodium bisulfite, sodium perborate, reducing sugars, and short chain alcohols; solvents and hydrotropes such as ethanol, isopropanol and xylene sulfonates; flow control agents (in granular forms); enzyme stabilizing agents; soil suspending agents; antiredeposition agents; anti-tarnish agents; anti-corrosion agents; colorants; other functional additives; and perfume. The pH of the cleaning composition may be adjusted by addition of strong acid or base. Such alkalinity or buffering agents include sodium carbonate and sodium borate.

Enzymes

Enzymes capable of facilitating the removal of soils from a substrate may also be present in the invention in an amount of from 0 to 10 weight percent, preferably 1 to about 5 weight percent. Such enzymes include proteases (e.g., Alcalase®, Savinase® and Esperase® from Novo Industries A/S), amylases (e.g., Termamyl® from Novo Industries), and lipases (e.g.. Lipolase® from Novo Industries).

Bleaching Agent

A wide variety of halogen and peroxygen bleach sources may be used in the present invention. Examples of such halogen and peroxygen bleaches are described in U.S. Pat. No. 5,200,236 issued to Lang et al., herein incorporated by reference.

Among suitable reactive chlorine or bromine oxidizing materials are heterocyclic N-bromo and N-chloro imides such as trichloroisocyanuric, tribromoisocyanuric, dibromoisocyanuric and dichloroisocyanuric acids, and salts thereof with water-solubilizing cations such as potassium and sodium. Hydantoin compounds such as 1,3-dichloro-5, 5-dimethylhydantoin are also quite suitable.

Dry, particular, water-soluble anhydrous inorganic salts are likewise suitable for use herein such as lithium, sodium or calcium hypochlorite and hypobromite. Chlorinated trisodium phosphate is another core material. Chloroisocyanurates are, however, the preferred bleaching agents. Potassium dichloroisocyanurate is said by Monsanto Company as ACL-59®. Sodium dichloroisocyanurates are also available from Monsanto as ACL-60®, and in the dihydrate form, from the Olin Corporation as Clearon CDB-56®, available in powder form (particle diameter of less than 150 microns); medium particle size (about 50 to 400 microns); and coarse particle size (150–850 microns). Very large particles (850–1700 microns) are also found to be suitable for encapsulation.

Peroxy Bleaching Agent

The oxygen bleaching agents of the compositions include organic peroxy acids and diacylperoxides. Typical monoperoxy acids useful herein include alkyl peroxy acids and aryl peroxy acids such as:

(i) peroxybenzoic acid and ring-substituted peroxybenzoic acids, e.g., peroxy-alpha-naphthoic acid, and magnesium monoperphthalate (ii) aliphatic and substituted aliphatic monoperoxy acids, e.g., peroxylauric acid, peroxystearic acid, epsilon-phthalimido peroxyhexanoic acid and o-carboxybenzamido peroxyhexanoic acid, N-nonenylamidoperadipic acid and N-nonenylamidopersuccinic acid.

Typical diperoxy acids useful herein include alkyl diperoxy acids and aryldiperoxy acids, such as:

(iii) 1,12-diperoxydodecanedioic acid (iv) 1,9-diperoxyazelaic acid (v) diperoxybrassylic acid; diperoxysebacic acid and diperoxy-isophthalic acid (vi) 2-decyldiperoxybutane-1,4-dioic acid (vii) N,N'-terephthaloyl-di(6-aminopercaproic acid).

A typical diacylperoxide useful herein includes dibenzoylperoxide.

Inorganic peroxygen compounds are also suitable for the present invention. Examples of these materials useful in the invention are salts of monopersulfate, perborate monohydrate, perborate tetrahydrate, and percarbonate.

Preferred oxygen bleaching agents include epsilon-phthalimido-peroxyhexanoic acid, o-carboxybenzamidoperoxyhexanoic acid, and mixtures thereof.

The oxygen bleaching agent is present in the composition in an amount from about of 1 to 20 weight percent, preferably 1 to 15 weight percent, most preferably 2 to 10 weight percent.

The oxygen bleaching agent may be incorporated directly into the formulation or may be encapsulated by any number of encapsulation techniques known in the art to produce stable capsules in alkaline liquid formulations.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to about 50° C. The wax coating has a thickness of from 100 to 1500 microns.

Bleach Precursors

Suitable peroxygen peracid precursors for peroxy bleach compounds have been amply described in the literature, including GB Nos. 836,988; 855,735; 907,356; 907,358; 907,950; 1,003,310 and 1,246,339; U.S. Pat. Nos. 3,332,882 and 4,128,494.

Typical examples of precursors are polyacylated alkylene diamines, such as N,N,N',N'-tetraacetylethylene diamine (TAED) and N,N,N',N'-tetraacetylmethylene diamine (TAMD); acylated glycolurils, such as tetraacetylglycoluril (TAGU); triacetylcyanurate, sodium sulphophyl ethyl carbonic acid ester, sodium acetyloxybenene sulfonate (SABS), sodium nonanoyloxy benzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromo-phenylbenzoate; sodium or potassium benzoyloxy benzene-sulfonate; and benzoic anhydride.

Preferred peroxygen bleach precursors are sodium p-benzoyloxybenzene sulfonate, N,N,N',N'-tetraacetylethylene diamine, sodium nonanoyloxybenzene sulfonate and choline sulfophenyl carbonate.

Process

The compositions containing the slow dissolving aluminum salts as defined herein may be prepared in any conventional manner known in the art to form any variety of physical forms of the compositions.

For the compositions containing the aluminum-sequestrant complex, it is essential that a premix of the sequestrant material and the aluminum salt be prepared prior to the incorporation of other components of the compositions of the invention. Once the premix is prepared, it may be processed with other detergent components in any conventional manner to form any variety of physical forms of automatic dishwashing detergent compositions, such as liquid, tablet, powder, gel.

To prepare the premix, the selected sequestrant should be completely dissolved in water to form a solution with a pH at least one pH unit greater than the pKa of at least one of the ionizable groups of the sequestrant. The pH must be maintained at this level during the entire dissolution step and the alkalinity of the solution may be adjusted by the addition of either an inorganic acid or an inorganic base, such as NaOH or $H_2SO_4$.

While maintaining the solution at a pH as described above, the selected aluminum salt is added to the solution and the pH is again adjusted to as close to the same pH as during the initial dissolution of the sequestrant as possible. Once the aluminum salt is dissolved into the sequestrant solution, the premix can be incorporated with other components to form the composition.

The following examples will serve to distinguish this invention from the prior art and illustrate its embodiments more fully. Unless otherwise indicated, all parts, percentages and proportions referred to are by weight.

EXAMPLE 1

It was surprisingly observed that at low and neutral pH levels (less than about pH 10) lead mineral from lead containing glassware was more substantially extracted than at higher pH. Specifically, lead containing glass tiles obtained from Q-Glass, Inc. of Towaco, N.J. and having a 50% lead content were soaked for 24 hours at 65° C. in one liter soft water containing 6.8 grams of an automatic dishwashing composition having the following formula:

| Ingredient | % of Active |
|---|---|
| CDB capsules[1] | 4.3 |
| Potassium tripolyphosphate | 34 |
| Polymer[2] | 1 |
| Buffering agents | 9 |
| Non-ionic surfactant | 2 |
| Potassium hydroxide (45% soln.) | 1 |
| Enzymes | 0.8 |
| Water | to balance |

[1]Chlorine supplied as CDB-56, which is 56% available chlorine, and encapsulated according to U.S. Pat. No. 5,200,236 issued to Lang et al. The resulting capsules are 50% CDB-56 and 50% wax coating.
[2]Carbopol 627, a high molecular polymer having a molecular weight of about one million supplied by B. F. Goodrich Company.

The pH's of the four solutions were adjusted to 7.5, 8.6, 9.5, and 10.5 with NaOH and $H_2SO_4$. After soaking, the lead containing glass tiles and an aliquot of each detergent solution were withdrawn. The lead tiles were weighed to determine weight loss. The aliquots were analyzed for metals using Inductively Coupled Plasma (ICP) spectrometry. The results of each analysis are presented in Table 1 below:

TABLE 1

| pH Value | Weight loss (%) | Lead Extracted (ppm) |
|---|---|---|
| 7.5 | 0.30 | 170 |
| 8.6 | 0.30 | 155 |

TABLE 1-continued

| pH Value | Weight loss (%) | Lead Extracted (ppm) |
|---|---|---|
| 9.5 | 0.20 | 90 |
| 10.5 | 0.07 | 30 |

Thus, as the alkalinity of the detergent compositions increased above about 10, the amount of lead extracted from the lead articles significantly decreased.

EXAMPLE 2

It was observed that the addition of selected aluminum salts to the automatic dishwashing composition of Example 1 significantly reduced the lead extracted from the lead containing glass tiles after soaking in a detergent solution.

Detergent solutions according to Example 1 and further containing various aluminum salts to deliver 2.2 millimoles Al(III) per liter were prepared. Lead containing glass tiles were soaked in the detergent solutions under the conditions described in Example 1 except that the pH's of the detergent solutions were maintained at 8.6. After soaking, aliquots of the solutions were analyzed using ICP to determine the amount of lead extracted into the detergent solution. The results of the experiment are presented in Table 2 below:

TABLE 2

| Detergent Compositions | Extracted Lead in ppm |
|---|---|
| Control (No aluminum salt) | 155 |
| Aluminum stearate | 35 |
| Aluminum acetate | 35 |
| Aluminum acetylacetonate | 65 |
| Aluminum phosphate | 70 |

It was thus observed that the addition of aluminum salts to the low alkalinity detergent solutions significantly reduced the amount of lead extracted from the lead containing articles.

EXAMPLE 3

To observe the effect of the presence of aluminum salts in an automatic dishwashing detergent composition, lead containing articles of having decors of various colors were washed in a dishwasher and the fading of the decor of the articles was scored.

Compositions according to Example 1 were prepared using various aluminum salts to deliver Al(III) in an amount of 2.2 millimoles Al(III) per liter in the dishwasher. A 1% solution of each of the compositions had a pH of 8.6. The following articles were washed in a Bauknecht dishwasher for 15 washes in soft water: 1 yellow plate, 1 red plate, 1 blue glass, 1 tweety glass and 1 orange glass. After the 15 washes, the articles were removed and scored for fading of decor from 0 (no fading) to 6 (substantially faded). The scored results are exhibited in Table 3 below:

TABLE 3

| Composition | Yellow Plate | Red Plate | Blue Glass | Tweety Glass | Orange Glass |
|---|---|---|---|---|---|
| Control (No aluminum salt) | 5 | 5 | 5 | 5 | 5 |

TABLE 3-continued

| Composition | Yellow Plate | Red Plate | Blue Glass | Tweety Glass | Orange Glass |
|---|---|---|---|---|---|
| Aluminum sulfate | 1 | 1.5 | 1.5 | 1.5 | 1.5 |
| Aluminum acetate | 0 | 0.5 | 1.5 | 0.5 | 2 |
| Aluminum acetylace-tonate | 0.5 | 1.5 | 1 | 1.5 | 0.5 |
| Aluminum ocotate | 1 | 1.5 | 1.5 | 3 | 3.5 |
| Aluminum phosphate | 4.5 | 3.5 | 4 | 5 | 5 |

It was observed that all the aluminum salt containing compositions exhibited less decor fading than those compositions which did not contain aluminum salts.

EXAMPLE 4

It has been surprisingly found that the presence of an aluminum salt can negatively impact the removal of stains, particularly tea stain, under the conditions obtained by using these detergent compositions. This is most likely caused by a direct interaction between aluminum and the stain. It has been also surprisingly found that controlling the release of aluminum can minimize this negative impact.

To observe the effect of the presence of aluminum salts in an automatic dishwashing detergent composition on tea stain removal, tea stained cups and saucers were washed in the dishwasher and scored with regard to stain removal.

Compositions according to Example 3 were prepared using various aluminum salts to deliver Al(III) in an amount of 2.2 millimoles Al(III) per liter in the dishwasher. A 1% solution of each of the compositions had a pH of 8.6. For each experiment, eight cups and eight saucers were stained in a tea liquor and allowed to dry. Four cups and four saucers of the original eight were stained an additional three times, yielding four cups and saucers stained once, and four cups and saucers stained four times. These articles were washed one (1) time in water containing 250 ppm permanent/320 ppm temporary hardness with the compositions described above. The scored results are exhibited in Table 4 below:

TABLE 4

| Composition | 4× cup | 4× saucer | 1× cup | 1× saucer |
|---|---|---|---|---|
| Control (No aluminum salt) | 0 | 0 | 0 | 0 |
| Aluminum sulfate | 5 | 5 | 5 | 5 |
| Aluminum acetate | 1 | 0 | 0 | 0 |
| Aluminum acetylace-tonate | 3 | 0 | 1 | 0.75 |
| Aluminum octoate | 0.25 | 0 | 0 | 0 |
| Aluminum phosphate | 0.5 | 0 | 0 | 0 |

From the above, it was observed that using slow-dissolving aluminum salts (i.e. aluminum acetate, aluminum octoate and aluminum phosphate) in the wash results in the bleaching of tea stains from stained articles significantly better than using fast-dissolving aluminum salts.

EXAMPLE 5

Another option to control the release of aluminum is by binding the aluminum to a sequestrant. Surprisingly, it has been found that this way aluminum can be prevented to interact with the stain, while still delivering its benefit of preventing lead leaching of decorated tableware.

For this option, the order of processing detergent compositions incorporating aluminum salts is critical in order to provide compositions which both effectively remove stains from articles and which inhibit extraction of minerals. To demonstrate the criticality of processing, selected cups and saucers were stained in tea, the most difficult stain to remove from tableware. Twelve cups and saucers were stained in a concentrated tea liquor, allowed to dry and then stained three additional times for a total of four tea stainings. For each of the detergent compositions described below, four cups and saucers were placed in a Bauknecht dishwasher and washed one (1) time:

Composition 1 was prepared by adding aluminum sulfate to deliver Al(III) in an amount to deliver of 0.8 millimoles Al(III) per liter in the dishwasher to the composition described in Example 1.

Composition 2 was not prepared according to the invention. Sodium citrate having $pK_a$ values of $pK_1$=3.1, $pK_2$=4.8 and $pK_3$=6.4 was selected as the sequestrant. Aluminum sulfate, in an amount to deliver 0.8 mM Al(III) in the wash was dosed into deionized water; during dosing, the pH of the solution was maintained at 9.5. After dosing the aluminum salt, sodium citrate to deliver 0.8 mM in the wash was added to the system. The pH of the resulting system was adjusted to 8.9 to form the premix. This premix was added to the composition described in Example 1 to generate Composition 2.

Composition 3 was prepared according to the invention. Sodium citrate in an amount to deliver 0.8 mM in the wash was completely dissolved in water; during dissolution, the pH of the solution was maintained at 9.5. Once the sequestrant completely dissolved, aluminum sulfate to deliver 0.8 mM Al(III) in the wash was added to the solution. The pH of the resulting solution was adjusted to 8.9 to form the premix. This premix was added to the composition described in Example 1 to generate Composition 3.

The stained articles were evaluated for residual tea stain. A score of 0 indicated that no tea stains were observed while a score of 5 indicated that a large amount of residual tea stain on the washed articles was observed. The results are presented in Table 5 below:

TABLE 5

| Composition | Residual Tea Stain |
|---|---|
| Composition 1-no sequestrant | 5 |
| Composition 2-incorrect premix process | 4 |
| Composition 3-correct premix process | 0 |

It was thus observed that incorrect processing of the aluminum salt and sequestrant components produces an inactive premix which interferes with the removal of tea stain from washed articles.

EXAMPLE 6

Various sequestrant materials were combined with aluminum sulfate to form a premix according to the invention and the effect of the premix on tea stain removal was observed.

Cups and saucers were stained as described in Example 5 above. Four samples of premix formulations were prepared to deliver 1.2 millimoles per liter of various sequestrant materials and 0.4 millimoles per liter of aluminum sulfate.

The stained articles were washed in a Bauknecht dishwasher according to Example 5 above and the washed articles were rated for residual tea stain with 0 being no stain remaining and 5 being significantly stained. The results are presented in Table 6 as follows:

TABLE 6

| Composition | Cups | Saucers |
|---|---|---|
| No sequestrant/aluminum salt | 5 | 4 |
| Succinic acid/aluminum salt | 3 | 0 |
| Malonic acid/aluminum salt | 2 | 0 |
| Cyanyric acid/aluminum salt | 1 | 0 |

It was thus observed that a premix of various sequestrant materials and the aluminum sulfate significantly reduced tea stain on washed articles when compared to articles washed with aluminum sulfate alone.

EXAMPLE 7

Various sequestrant materials were combined with sodium aluminate to form a premix according to the invention and the effect of the premix on tea stain removal was observed.

Cups and saucers were stained as described in Example 5 above. Four samples of premix formulations were prepared to deliver 1.2 millimoles per liter of various sequestrant materials and 0.4 millimoles per liter of sodium aluminate. The stained articles were washed in a Bauknecht dishwasher according to Example 5 above and the washed articles were rated for residual tea stain with 0 being no stain remaining and 5 being significantly stained. The results are presented in Table 7 as follows:

TABLE 7

| Composition | Cups | Saucers |
|---|---|---|
| no sequestrant | 5 | 4 |
| EDTA | 0 | 0 |
| Sodium orthophospate | 1 | 0 |

It was thus observed that the use of a premix of sequestrants with different aluminum salts according to the invention significantly reduces residual tea stain relative to the use of the aluminum salts alone.

EXAMPLE 8

Benzoic acid was combined with aluminum sulfate at differing ratios to form a premix according to the invention. The effect of these premixes on tea stain removal was observed.

Cups were stained as described in Example 5. Five samples of premix formulations were prepared to deliver 0.4 millimoles per liter of aluminum sulfate at differing ratios to benzoic acid. The stained articles were washed in a Bauknecht dishwasher according to Example 5. The washed articles were rated for residual tea stain with 0 being no stain remaining and 5 being significantly stained. The results are presented in Table 8 as follows:

TABLE 8

| Ratio of benzoic acid to Al(III) | Cups |
|---|---|
| 1:2 | 1.25 |
| 1:1 | 1.0 |
| 1.5:1 | 0 |
| 3:1 | 0 |

It was thus observed that as the ratio of benzoic acid to aluminum is increased, the tea stain removal performance of the resulting premix improves.

EXAMPLE 9

Sodium citrate was combined with aluminum sulfate to form a premix according to the invention. The percent transmittance of each of these premixes was determined by using a Brinkmann PC800 Colorimeter. The effect of pH on percent transmittance of the premix, relative to deionized water, was observed.

Five solutions of premix formulations were prepared to deliver 10 millimoles per liter of sodium citrate and 5 millimoles per liter of aluminum sulfate. The pH of these solutions was adjusted with sulfuric acid or sodium hydroxide, as necessary, to pH values ranging from 7 to 11.

The percent transmittance of these solutions, relative to deionized water, was analyzed. The results are presented in Table 9 as follows:

TABLE 9

| pH | % Transmittance |
|---|---|
| 7 | 95 |
| 8 | 98 |
| 9 | 98 |
| 10 | 97 |
| 11 | 100 |

It was thus observed that premixes prepared correctly show no precipitation of any aluminum compound at the pH's evaluated.

One sample of inactive premix was prepared to deliver 5 millimoles aluminum sulfate per liter and 10 millimoles sodium citrate per liter. This premix was not prepared according to the invention. The pH of this premix was adjusted to 9 with sodium hydroxide and the percent transmittance of this premix was observed to be 65%. It was thus shown that the incorrect preparation of the premix leads to precipitation of an aluminum compound.

We claim:

1. An automatic dishwashing detergent composition which substantially inhibits lead corrosion of fine tableware comprising:

a) 0.01 to about 25 wt. % of an aluminum salt which dissolves at a rate to deliver less than 0.56 mM aluminum(III) per minute at 42° C. to a wash liquor;

b) 1 to 20 wt. % of a bleaching agent selected from a group of a peroxygen agent, a hypohalite agent, corresponding salts and its mixtures thereof;

c) 1 to 75 wt. % of a builder;

d) 0 to 40 wt. % of a surfactant;

e) 0–5% of a silicate.

and a 1% aqueous solution of the detergent composition having a pH of about 7 to about 8.6.

2. An automatic dishwashing detergent composition according to claim 1 wherein the aluminum salt is selected from the group consisting of aluminum stearate, aluminum tartrate, aluminum acetate, aluminum acetotartrate, aluminum salicylate, aluminum bis(acetylsalicylate), aluminum formate, aluminum borate, aluminum palmitate, aluminum acetylacetonate, aluminum phosphate, aluminum octoate, aluminum oleate and mixtures thereof.

3. A detergent composition according to claim 2 wherein the aluminum salts are selected from the group consisting of aluminum acetate, aluminum acetylacetonate, aluminum octoate, aluminum phosphate and mixtures thereof.

4. A detergent composition according to claim 1 wherein the aluminum salt is incorporated in the detergent composition in an amount to deliver about 0.1 mM to about 10 mM of aluminum(III) in the wash liquor.

5. A detergent composition according to claim 1 wherein the builder is selected from inorganic or organic water soluble builder salts, and mixtures thereof.

6. A detergent composition according to claim 5 wherein the organic builder is selected from a group consisting of alkali metal citrates, succinates, aluminosilicates, polycarboxylates, tartrate disuccinates and mixtures thereof.

7. A detergent composition according to claim 1 wherein the peroxygen agent is an organic agent or an inorganic agent.

8. A detergent composition according to claim 7 wherein the organic agent is selected from the group consisting of epsilon-phthalimido peroxyhexanoic acid, O-carboxybenzamidoperoxyhexanaoic acid, N,N-terephthaloyldi(6-amino percaproic acid) and mixtures thereof.

9. A detergent composition according to claim 7 wherein the inorganic agent is selected from a group consisting of salts of monopersulfate, perborate monohydrate, perborate tetrahydrate, percarbonate and mixtures thereof.

10. A detergent composition according to claim 1 further comprising a peroxygen peracid precursor.

11. A detergent composition according to claim 10 wherein the peroxygen peracid precursor is selected from a group consisting of sodium p-benzoyloxybenzene sulfonate, $N,N,N^1,N^1$-tetraacetylethylenediamine, sodium nonanoyloxybenzene sulfonate and choline sulfophenyl carbonate.

12. A detergent composition according to claim 1 wherein the hypohalite agent is sodium hypochlorite.

13. A detergent composition according to claim 1 further comprising 1 to 5 wt. % enzyme selected from the group consisting of a protease, an amylase, a lipase and mixtures thereof.

14. A detergent composition according to claim 1 wherein the surfactant is a nonionic surfactant.

15. A method for substantially inhibiting lead corrosion of fine tableware in an automatic dishwashing machine comprising the steps of:

washing the fine tableware in an effective amount of a detergent composition comprising:

i) 0.01 to about 25 wt. % of an aluminum salt which dissolved at a rate to deliver less than 0.56 mM aluminum(III) per minute at 42° C. to a wash liquor;

ii) 1 to 20 wt. % of a bleaching agent selected from a group of a peroxygen agent, a hypohalite agent, corresponding salts and mixtures thereof;

iii) 1 to 75 wt. % of a builder, iv) 0 to 40 wt. % of a surfactant, v) 0–5% of a silicate;

and an aqueous solution having a pH of about 7 to about 8.6 to substantially prevent corrosion of fine tableware containing lead.

16. A method according to claim 15 wherein the aluminum salt is selected from the group consisting of aluminum stearate, aluminum tartrate, aluminum acetate, aluminum acetotartrate, aluminum salicylate, aluminum bis (acetylsalicylate), aluminum formate, aluminum borate, aluminum palmitate, aluminum acetylacetonate, aluminum phosphate, aluminum octoate, aluminum oleate and mixtures thereof.

17. A method according to claim 15 wherein the aluminum salt incorporated in the detergent composition in an amount to deliver about 0.1 mM to about 10 mM of aluminum(III) in the wash liquor.

* * * * *